United States Patent [19]

Ranga

[11] 4,132,859

[45] Jan. 2, 1979

[54] SOUND REPRODUCING APPARATUS

[76] Inventor: Egils Ranga, 76 Nibshaw La., Gomersal, Cleckheaton, W. Yorkshire, England

[21] Appl. No.: 856,972

[22] Filed: Dec. 2, 1977

[30] Foreign Application Priority Data

Dec. 4, 1976 [GB] United Kingdom..... 50639/76

[51] Int. Cl.[2] ..... H04R 5/00

[52] U.S. Cl. ..... 179/1 GQ; 179/1 G; 179/1 GP

[58] Field of Search ..... 179/1 GQ, 1 G, 1 GP, 179/1 GA, 100.4 ST

[56] References Cited

U.S. PATENT DOCUMENTS

| | | | |
|---|---|---|---|
| 3,280,258 | 10/1966 | Curtis | 179/1 G |
| 3,697,692 | 10/1972 | Hafler | 179/1 GQ |
| 3,813,494 | 5/1974 | Bauer | 179/1 GQ |
| 3,818,136 | 6/1974 | Schott | 179/1 GQ |
| 4,002,835 | 1/1977 | Bumber | 179/1 GQ |
| 4,034,158 | 7/1977 | Britton | 179/1 GQ |

OTHER PUBLICATIONS

"The 'Stereo-Plus' System", Audio, Oct. 1959, Shottenfield & Staudt, p. 23.

*Primary Examiner*—Kathleen H. Claffy
*Assistant Examiner*—Gerald L. Brigance
*Attorney, Agent, or Firm*—Norris & Bateman

[57] ABSTRACT

A unit for use in coupling a pair of loudspeakers to an amplifier having two channels comprises a transformer having a first winding and a second winding, one end of a first winding having a first connection device for connecting the first winding in series with one of the loudspeakers, one end of the second winding having a second connection device for connecting the second winding in series with the other of the loudspeakers, the windings being electrically connected asymmetrically, and the other ends of the first and second windings having means for connecting the other ends to the negative supply line of the amplifier. This unit can be used advantageously in connecting the front speaker pair of a "surround-sound" or four speaker sound reproduction system. The remaining speaker pair is then connected in a conventional Hafler arrangement.

17 Claims, 12 Drawing Figures

SOUND REPRODUCING APPARATUS

BACKGROUND TO THE INVENTION

The invention relates to sound reproducing apparatus.

DESCRIPTION OF THE PRIOR ART

Various forms of sound reproducing apparatus utilising four loudspeakers are already known. There are two general types of so-called quadraphonic systems, namely discrete systems and matrix systems. In a discrete system four separate signals are generated and recorded (e.g., on tape). The four signals are then replayed, are separately amplified using a four-channel amplifier, and are reproduced utilising four loudspeakers. With such a system there is a minimum of cross-talk between the four signals.

In a matrix system the four original signals are combined or coded to give two complex signals which are then recorded. When the two complex or coded signals are played back, they are decoded to give four signals again, which are then amplified in a four-channel amplifier and reproduced using four loudspeakers. Since the four signals are not kept totally separate throughout, there is a certain amount of cross-talk between the reproduced signals, the extent and manner of cross-talk being dependent on the type of matrix system employed.

A degree of cross-talk between channels can be useful as it reduces 'holes' in the surround-sound image between loudspeakers.

Matrix systems are more suitable than discrete systems for use with broadcasting and disc recordings, because the broadcasting and disc recording of four separate signals presents more problems than the recording of four separate signals on tape. One known system is known as Regular Matrix. In a matrix system, certain relationships between the left and right stereo signals give certain image locations in the sound field. In the Regular Matrix system, referring to FIG. 7, left and right in-phase signals are associated with zone A, left and right anti-phase signals are associated with zone B, left signals are associated with zone C and right signals are associated with zone D.

The relationship between the two signal voltages recorded and the signal voltages subsequently applied to the four speakers can be represented in general terms by the following equations:

$$L_F = (1 - m)L + m.R$$

$$R_F = (1 - m)R + m.L$$

$$L_B = (1 - n)L - n.R$$

$$R_B = (1 - n)R - n.L$$

Where $L_F$ = the voltage applied to the left front speaker
$R_F$ = the voltage applied to the right front speaker
$L_B$ = the voltage applied to the left back speaker
$R_B$ = the voltage applied to the right back speaker
L = the left complex or coded signal voltage
R = the right complex or coded signal voltage
m and n are numerical values greater than 0 and less than $\frac{1}{2}$ In order to give linear overall volume balance, m and n should be equal in value, and furthermore, it can be shown that to provide excellent diagonal separation and signal separation between the left and right speakers which is equal to the signal separation between the front and back speakers, a desirable feature in quadraphonic sound reproduction, m and n should both equal one minus the square root of $\frac{1}{2}$ so that the decoding equations become as follows:

$$L_F = 0.707L + 0.293R$$

$$R_F = 0.707R + 0.293L$$

$$L_B = 0.707L - 0.293R$$

$$R_B = 0.707R - 0.293L$$

Quadraphonic systems are relatively expensive, requiring the use of a four-channel amplifier. Attempts have been made to produce systems providing so-called pseudo-quadraphony, using a conventional stereo two-channel amplifier. One known system makes use of what is known as a Hafler connection for the rear pair of speakers, as shown in FIG. 1.

The left front speaker $L_F$ is connected to the left channel output terminals 10 and 11 of the two channel amplifier (not shown) and the right front speaker $R_F$ is connected to the right channel output terminals 12, 13 of the amplifier. The rear speakers are connected to reproduce mainly the difference between the left and right channel signals. In view of the low output impedance of modern amplifiers, the Hafler connection does not cause the rear speakers to reduce the stereo separation of the front speakers, and so the front speakers reproduce normal stereo. The anti-phase signals reproduced by the rear speakers on the other hand, are somewhat similar to the sounds which are received from the rear when one attends an actual musical performance, produced by reverberation for example, and so a surround-sound effect is produced.

However even when using a Hafler connection for the rear speakers, there is a significant and noticeable difference between quadraphonic systems and known pseudo-quadraphonic systems and furthermore the overall volume balance and the load on the amplifier is non-linear when a Hafler connection is used. FIG. 2 shows the variation in overall volume balance with the type of signal received. In the simplest form of Hafler connection, without a resistor b connected between the rear speaker common connection 14 and the negative supply line 15, in-phase left and right signals each having a voltage level of 0.707 unit produce a volume level of $\frac{1}{2}$ in each front speaker and nothing in the rear speakers giving a total volume level of one unit. However anti-phase left and right signals each having a voltage level of 0.707 unit produce a volume level of $\frac{1}{2}$ in each of the four speakers giving a total volume level of two units. A signal in one channel only, having a voltage level of one unit produces a volume level of 1 in the associated front speaker and $\frac{1}{4}$ in each of the rear speakers giving a total volume level of $1\frac{1}{2}$ as indicated by points 16 and 17. The resistor b, which improves left to right separation at the expense of front to back separation, can improve the overall balance, for example to give the dotted line shown in FIG. 2, but the overall volume balance is still non-linear.

OBJECT OF THE INVENTION

It is the object of the invention to provide a very close approximation to Regular Matrix quadraphony, and hence to provide linear overall volume balance and good signal separation between rear and front loudspeakers for anti-phase signals.

SUMMARY OF THE INVENTION

I have deduced that the object of the invention can be achieved by utilising a modified connection for a front loudspeaker pair.

Accordingly the invention provides a pair of loudspeakers for use as the front loudspeaker pair of a surround-sound reproduction system, one of the loudspeakers being connected in series with one winding of a transformer and the other of the loudspeakers being connected in series with another winding of the transformer, the windings being electrically connected asymmetrically.

The invention also provides a unit for use in coupling a pair of loudspeakers to an amplifier having two channels, for use as the front loudspeaker pair of a surround-sound reproduction system, the unit comprising a transformer having a first winding and a second winding, one end of a first winding having a first connection device for connecting the first winding in series with one of the loudspeakers, one end of the second winding having a second connection device for connecting the second winding in series with the other of the loudspeakers, the windings being electrically connected asymmetrically, and the other ends of the first and second windings having means for connecting the other ends to the negative supply line of the amplifier.

DESCRIPTION OF EMBODIMENTS OF THE INVENTION

Figure 1:
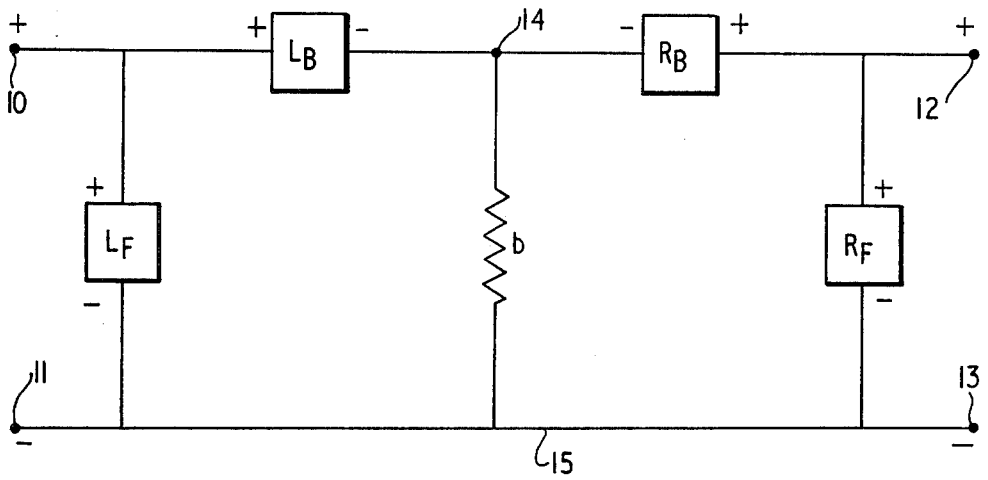
PRIOR ART FIG.1.
FIG. 1 illustrates a conventional four loudspeaker sound reproducing system.
Figure 2:
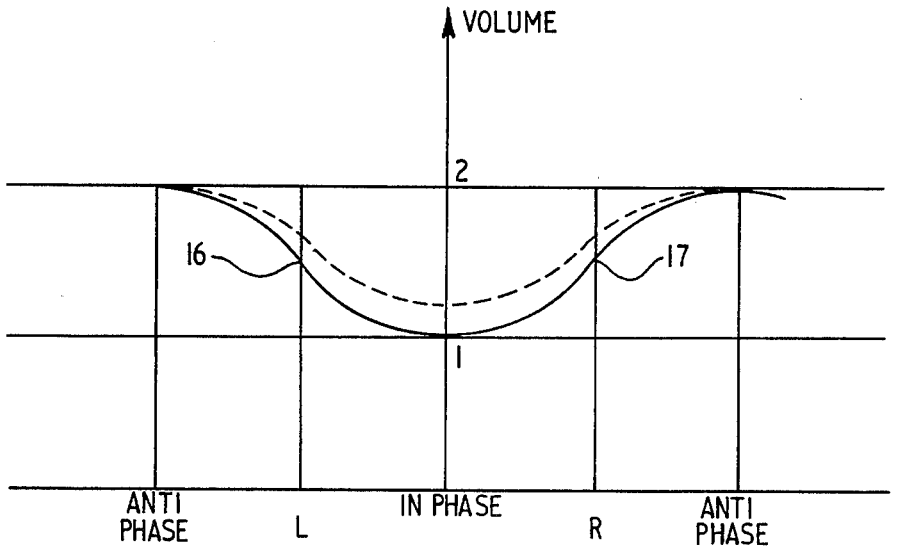
FIG. 2 is a diagram giving a measure of the overall volume balance for the system shown in FIG. 1.
Figure 3:
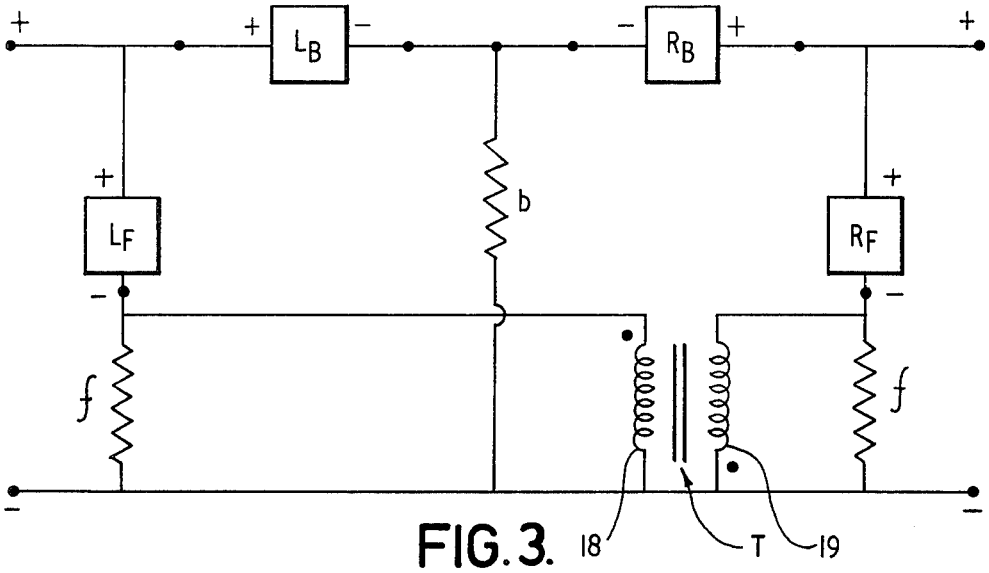
FIG. 3 illustrates a sound reproduction system according to the invention.
Figure 4A:
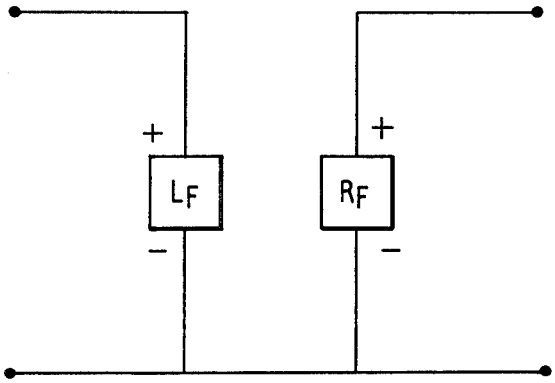
FIGS. 4(*a*) to 4(*d*) are the equivalent circuits for the front speaker circuit, under various conditions.
Figure 4B:
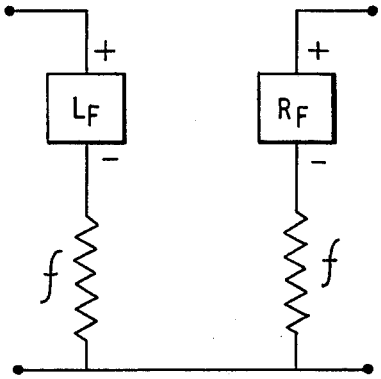
Figure 4C:
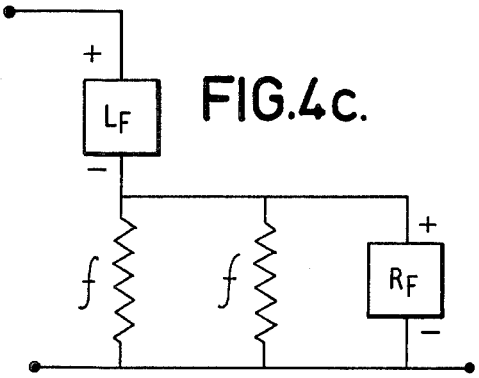
Figure 4D:
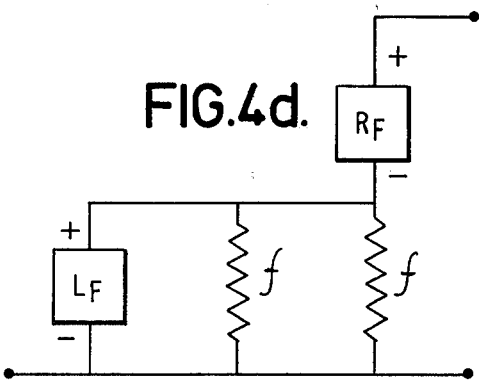

Considering FIG. 3, the left front speaker $L_F$ is connected in series with one winding 18 of a speaker isolation transformer T. The turns ratio of the transformer is one-to-one and the winding resistances are low. The right front speaker $R_F$ is connected in series with the other winding 19, the two windings being electrically connected asymmetrically. In parallel with each of the transformer windings is a resistor f.

Because of the asymmetric connection of the windings, the transformer is equivalent to a short circuit when left and right in-phase signals are received. Because of the opposing effects of the ampere-turns there is no magnetic flux and the transformer windings can be regarded as straight wires. When left and right anti-phase signals are received, the reactance of the mutual inductance of the transformer windings is much greater than the impedance of the loudspeakers for the range of frequencies involved, and therefore the transformer is effectively an open circuit. The equivalent circuits for the front speaker pair under various conditions are shown in FIGS. 4(*a*) to 4(*d*).

FIG. 4(*a*) illustrates the equivalent circuit when the left signal voltage is in phase with the right signal voltage and is of equal magntitude. The resistors f are shorted out and the circuit is equivalent to the normal stereo connection.

FIG. 4(*b*) illustrates the equivalent circuit when the left and right signal voltages are of equal magnitude but are in anti-phase. The transformer is equivalent to an open circuit. It will be seen that the presence of resistors f reduces the voltage across the front speakers and thus reduces the extent to which anti-phase signals are reproduced. This helps to compensate for the extent to which anti-phase signals are reproduced by the rear speakers and assists in producing linear overall volume balance.

FIG. 4(*c*) illustrates the equivalent circuit for the case where a left signal only is received, and FIG. 4(*d*) illustrates the equivalent circuit for the case where a right signal only is received. It will be seen that voltage across each front speaker is again reduced, though to a lesser extent, and that there is some degree of cross-talk between the left and right speakers, which is similar to the effect produced by Regular Matrix quadraphonic systems.

It can also be seen from the equivalent circuits that the resistors f improve left to right separation at the expense of front to back separation.

Figure 5:
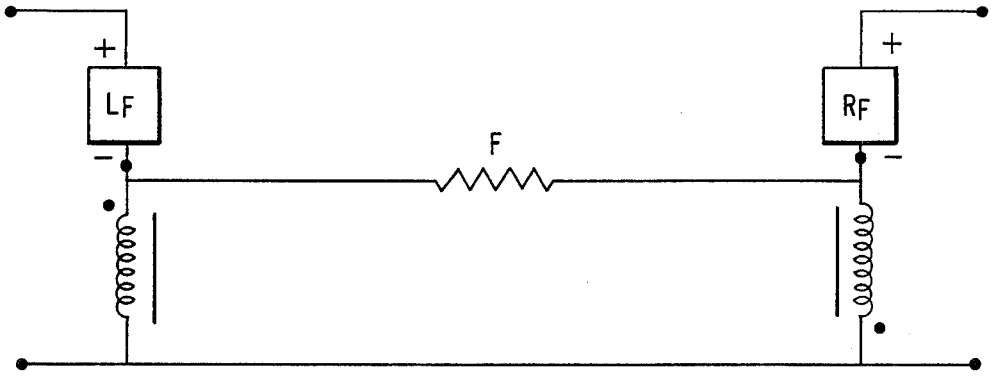
FIG. 5 illustrates an alternative front speaker arrangement according to the invention.
Figure 6:
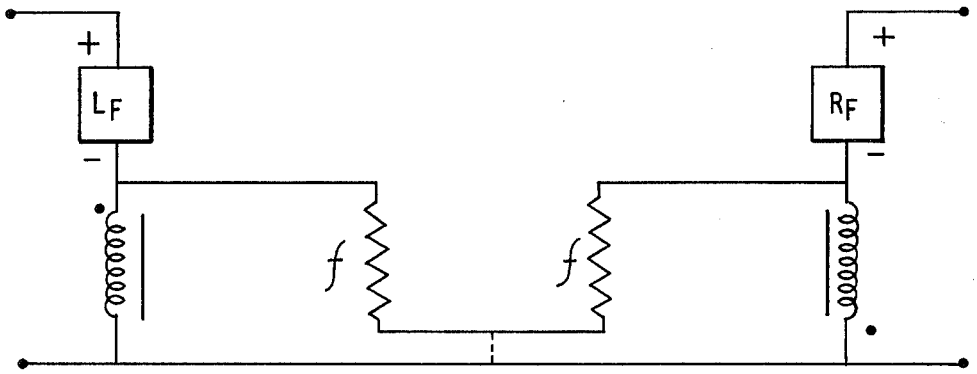
FIG. 6 illustrates how the circuit shown in FIG. 5 compares with the circuit shown in FIG. 3.
Figure 7:
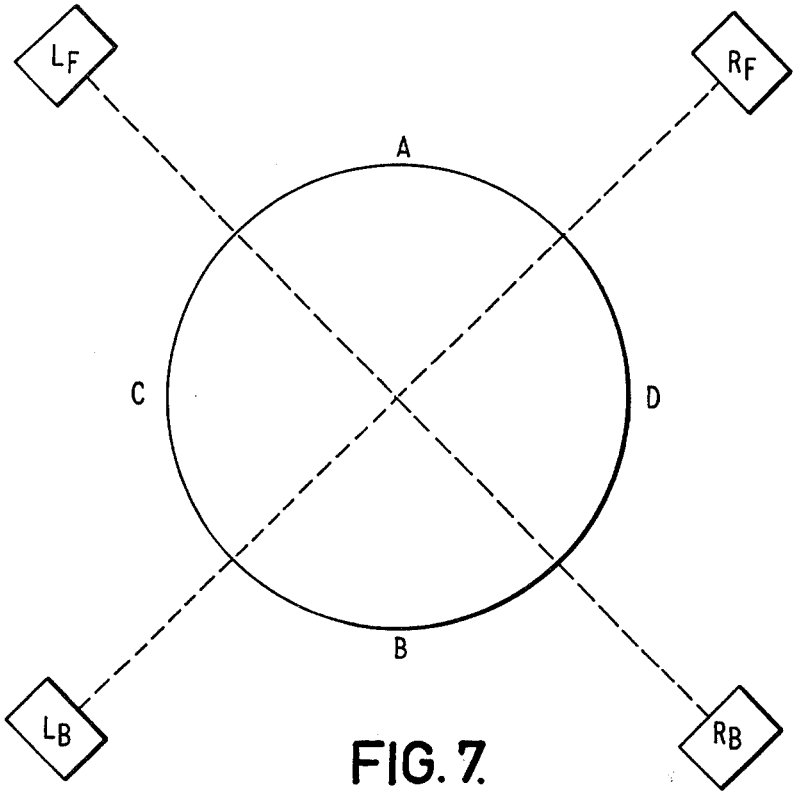
FIG. 7 illustrates diagrammatically the relationship between signals and image locations.

FIG. 5 shows an alternative front speaker connection in which the two resistors f are replaced by a single resistor F connected between the ends of the windings of the transformer which are connected to the front speakers. It can be seen that this is equivalent to the connection shown in FIG. 3 by considering the FIG. 3 connection redrawn as shown in FIG. 6. Any signal voltage across one of the transformer windings produces a corresponding negative signal voltage across the other winding, due to the action of the asymmetrically connected transformer. Consquently the voltage at the mid-point between the resistors f is zero and therefore the connection shown in dotted lines has no effect. The two resistors f can therefore be replaced by the single resistor F.

I have calculated that for the connection shown in FIG. 5, the voltages for the left and right front speakers can be given by the following equations:

$$L_F = \left\{1 - \frac{1}{2 + \frac{4r}{F}}\right\} L + \left\{\frac{1}{2 + \frac{4r}{F}}\right\} R$$

$$R_F = \left\{1 - \frac{1}{2 + \frac{4r}{F}}\right\} R + \left\{\frac{1}{2 + \frac{4r}{F}}\right\} L$$

Where r is the impedance of each of the front loudspeakers. These equations have the same general form as those of Regular Matrix and so by selecting an appropriate value of F, the equations can be made identical to the ideal equations for the front speakers of the Regular Matrix system. The resistor F, and the resistors f of the connection shown in FIG. 3, may be variable, so that their value may be adjusted to suit the impedance of any loudspeakers with which the connection is used.

I have also calculated that for the rear speakers, the voltages can be given as follows:

$$L_B = \left\{1 - \frac{1}{2 + \frac{r}{b}}\right\} L - \left\{\frac{1}{2 + \frac{r}{b}}\right\} R$$

$$R_B = \left\{1 - \frac{1}{2 + \frac{r}{b}}\right\} R - \left\{\frac{1}{2 + \frac{r}{b}}\right\} L$$

Where r is the speaker impedance. Thus by appropriate selection of the value of b the rear speaker equations can also be made identical to the ideal equations for the Regular Matrix system. Resistor b may also be variable.

In practice, the best values of resistors b and F are determined with reference to the excellent diagonal separation feature of the Regular Matrix system. For instance, b is determined by playing a mono source, adjusting the amplifier balance to a position corresponding to, say, left front and adjusting b until the volume in the opposite right back speaker is minimal. F is similarly determined using an anti-phase source, obtained, for instance, by reversing the connections of one channel at the cartridge and playing a mono record.

The correct connection of the transformer is confirmed in practice by, for example, checking that high frequencies are not attenuated from the front speakers for a centre mono signal.

It can be seen that the front speaker connection described above complements the rear speaker Hafler connection and makes it possible to produce speaker signals which are derived from the left and right signals in a mathematically similar way to the speaker signals in a Regular Matrix system. Furthermore, since the rear speakers reproduce mainly anti-phase signals, to a lesser extent single left and right signals, and to an even lesser extent in-phase signals, whereas the front speakers reproduce mainly in-phase signals, to a lesser extent single left and right signals, and to an even lesser extent anti-phase signals, the net result is a linear overall volume balance.

A further and perhaps more important advantage is that there is produced good signal separation between the rear and front speakers for anti-phase signals. Sounds intended for the rear and the sides can be heard and located more precisely.

Unlike a conventional Hafler connection, the combined circuit minimises the cross feeding of signals between channels.

It can be shown that the power rating of the transformer only needs to be a maximum of one quarter of that of the per channel output of the stereo amplifier. Similarly the rating of each resistor only needs to be one quarter also. However distortion considerations may require the use of a larger transformer.

The invention is not restricted to the details of the foregoing examples. For instance switches may be incorporated in the circuit to enable the circuit to be switched from the arrangement shown to the conventional stereo connection, or to enable one or more speakers to be switched off.

F and b may be made complex to match impedance variation with frequency of the speakers with which they are used, particularly high fidelity speakers using cross-over networks.

Figure 8:
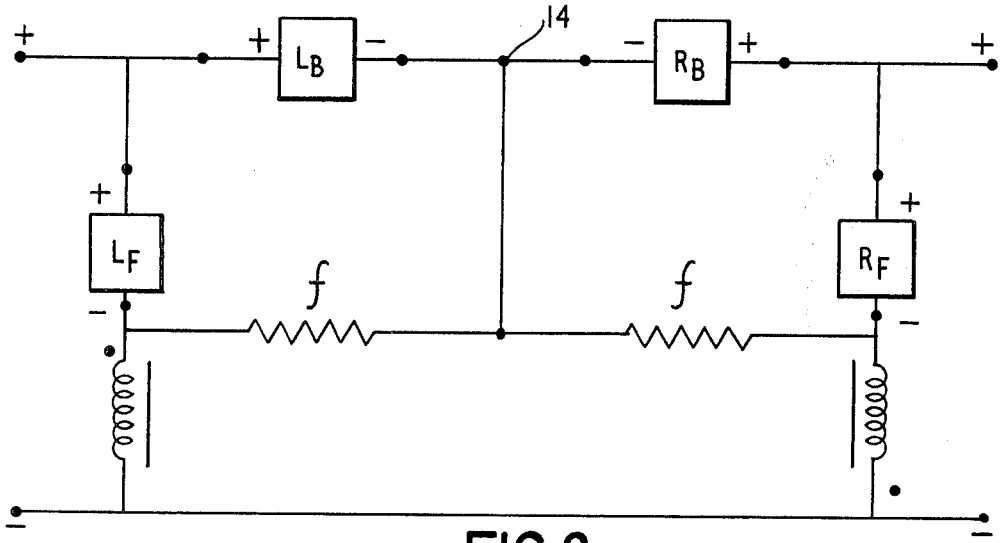
FIGS. 8 and 9 illustrate still further embodiments of the invention.

FIG. 8 illustrates a further embodiment according to the invention in which the same connection is utilised for the front speaker pair as in FIG. 5 but the rear speaker connection is modified by omitting the resistor b and connecting the rear speaker common connection 14 directly to the mid point of resistor F. In FIG. 8 resistor F is represented as two separate resistors each having the value f.

It can be shown that this arrangement still produces Regular Matrix and it has the advantage that it only requires two resistors of equal value, instead of two resistors F and b of different values. Since there is therefore only one variable, the best value can be obtained utilising a mono source as described above when determining the best value of resistor b. There is no need to utilise an anti-phase source. It can also be shown that there is linear volume balance, irrespective of the value of f. The four speakers should have the same impedance.

With the above described embodiments, it has been assumed that the loudspeakers will be arranged in a square. If however the speakers are positioned at the corners of a rectangle, or of a trapezium, the value of the resistors can be adjusted to maintain directional accuracy.

Figure 9:
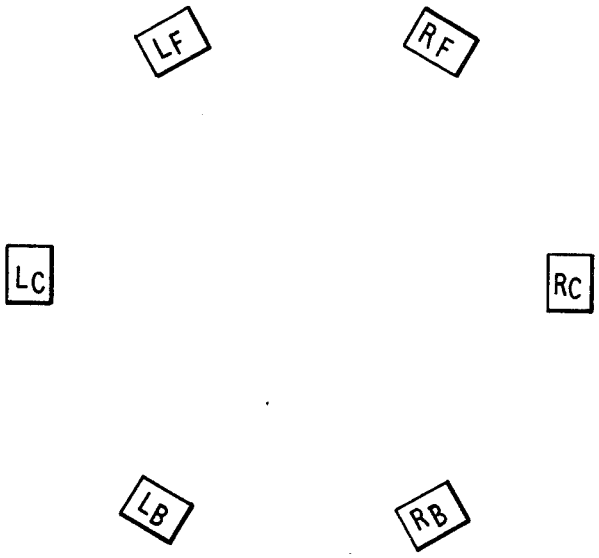

The resistors f shown in FIG. 8 may be replaced by an additional pair of loudspeakers, the six loudspeakers being arranged in a hexagonal formation for listening purposes, as shown in FIG. 9. The resistor f on the left in FIG. 8 is replaced by loudspeaker Rc and the resistor f on the right in FIG. 8 is replaced by loudspeaker Lc. Such an arrangement helps matching and furthermore power is not being wasted in resistors f. The power is utilized by the additional loudspeakers and so more sound is produced.

The theory utilised throughout the above specification is based on Regular Matrix type encoded signals assuming an ideal transformer and a square speaker layout. However other phase and amplitude relationships are possible and similar theory can be developed to show advantages of the invention for such different relationships, although for the purposes of illustration it is sufficient for an understanding of circuit operation to consider the theory relating to Regular Matrix type encoded signals.

The variable resistors may each comprise a wire-wound potentiometer or a set of resistors in combination with a switch.

The term transformer used throughout this specification is intended to include not only a single transformer but also two or more transformers so connected as to be electrically equivalent to a single transformer. When more than one transformer is used, they may for example be connected together in series or in parallel.

I claim:

1. A pair of loudspeakers for use as the front loudspeaker pair of a surround-sound reproduction system, one of the loudspeakers being connected in series with one winding of a transformer and the other of the loudspeakers being connected in series with another winding of the transformer, the windings being electrically connected asymmetrically.

2. A pair of loudspeakers as claimed in claim 1, in which the ends of the windings which are not connected to the loudspeakers have a common connection.

3. A pair of loudspeakers as claimed in claim 1, in combination with an amplifier having two channels, one front loudspeaker and the transformer winding in series therewith being connected across one channel of the amplifier and the other front loudspeaker and the transformer winding in series therewith being connected across another channel of the amplifier.

4. A pair of loudspeakers as claimed in claim 3, in which the common connection of the amplifier is connected to the ends of the windings which are not connected to the loudspeakers, thereby providing said ends with a common connection.

5. A pair of loudspeakers as claimed in claim 2, in which the said windings of the transformer comprise portions of a continuous winding, said common connection comprising a tapping on the continuous winding.

6. A pair of loudspeakers as claimed in claim 1, in which at least one winding of the tranformer has a resistor connected in parallel therewith.

7. A pair of loudspeakers as claimed in claim 1, in which a resistor is connected between the ends of the windings which are connected to the loudspeakers.

8. A pair of loudspeakers as claimed in claim 1, in combination with a pair of rear loudspeakers, the rear loudspeakers being interconnected by a Hafler connection.

9. A pair of loudspeakers as claimed in claim 8, in combination with a third pair of loudspeakers, the third pair being connected in series between the ends of the transformer windings which are connected to the pair of front loudspeakers, and the common connection of the third pair of loudspeakers being connected to the common connection of the pair of rear loudspeakers.

10. A unit for use in coupling a pair of loudspeakers to an amplifier having two channels for use as the front loudspeaker pair of a surround-sound reproduction system, the unit comprising a transformer having a first winding and a second winding, one end of the first winding having a first connection device for connecting the first winding in series with one of the loudspeakers, one end of the second winding having a second connection device for connecting the second winding in series with the other of the loudspeakers, the windings being electrically connected asymmetrically, and the other ends of the first and second windings having means for connecting to the negative supply line of the amplifier.

11. A unit as claimed in claim 10, in which the said other ends of the first and second windings have a common connection for use in connecting to the negative supply line of the amplifier.

12. A unit as claimed in claim 11, in which the said windings of the transformer comprise portions of a continous winding, said common connection comprising a tapping on the continuous winding.

13. A unit as claimed in claim 10, in which the said other ends of the first and second windings each have separate means for connecting to the negative supply line of the amplifier so that the said other ends do not have a common connection but are both connected to the negative supply line of the amplifier.

14. A unit as claimed in claim 10, in which as least one winding of the transformer has a resistor connected in parallel therewith.

15. A unit as claimed in claim 10, in which a resistor is connected between the first and second connection devices.

16. A unit as claimed in claim 10, comprising a Hafler connection for use in interconnecting a pair of rear loudspeakers for use as the rear loudspeaker pair of the surround-sound reproduction system.

17. A unit as claimed in claim 16, having means for connecting a third pair of loudspeakers in series between said first and second connection devices with the common connection of the third pair of loudspeakers being connected to the common connection of the pair of rear loudspeakers.

* * * * *